US006112921A

United States Patent [19]

Robinson

[11] Patent Number: 6,112,921

[45] Date of Patent: Sep. 5, 2000

[54] CHILD-RESISTANT SQUEEZE-AND-TURN CLOSURE, PACKAGE AND METHOD OF MANUFACTURING

[75] Inventor: Philip J. Robinson, Sylvania, Ohio

[73] Assignee: Owens-Illinois Closure Inc., Toledo, Ohio

[21] Appl. No.: 09/416,303

[22] Filed: Oct. 12, 1999

[51] Int. Cl.[7] ..... B65D 55/02

[52] U.S. Cl. ..... 215/216; 215/221

[58] Field of Search ..... 215/216, 217, 215/219, 221

[56] References Cited

U.S. PATENT DOCUMENTS

| | | | |
|---|---|---|---|
| 3,917,097 | 11/1975 | Uhlig . | |
| 4,002,258 | 1/1977 | Curry . | |
| 4,006,836 | 2/1977 | Micallef . | |
| 4,413,742 | 11/1983 | Sandhaus . | |
| 4,479,585 | 10/1984 | Sandhaus . | |
| 5,394,999 | 3/1995 | Krall . | |
| 5,449,077 | 9/1995 | Seidler . | |
| 5,460,281 | 10/1995 | Rapchak et al. . | |
| 5,603,421 | 2/1997 | Opresco . | |
| 5,664,693 | 9/1997 | Krall . | |
| 5,671,853 | 9/1997 | Herr . | |
| 5,687,863 | 11/1997 | Kusz . | |
| 5,706,963 | 1/1998 | Gargione . | |
| 5,722,546 | 3/1998 | Briere . | |
| 5,865,330 | 2/1999 | Buono . | |
| 5,908,125 | 6/1999 | Opresco | 215/216 |
| 5,927,526 | 7/1999 | Herr | 215/216 |
| 6,036,036 | 3/2000 | Bilani et al. | 215/216 |

*Primary Examiner*—Stephen K. Cronin

[57] ABSTRACT

A child-resistant closure that includes a base wall, a peripheral outer wall extending from the base wall, and an inner wall spaced radially inwardly from the outer wall and having an internal thread for securement to a container finish. The outer wall of the closure has diametrically opposed circumferential gaps, and the inner wall extends axially in radial alignment with the gaps in the outer wall for circumferential abutment with lugs on a shoulder of the container. The inner wall is flexible inwardly for clearing the container lugs and permitting removal of the closure from the container finish. The outer wall thus protects the force application area of the inner wall by reason of the fact that such force application area is recessed inwardly with respect to the circumference of the outer wall. The closure resists application of planer force to the removal area of the inner wall, such as by a child biting the closure. Furthermore, the modified dual-wall construction of the present invention may be constructed in small sizes suitable for use in conjunction with containers having small finish diameters.

18 Claims, 2 Drawing Sheets

CHILD-RESISTANT SQUEEZE-AND-TURN CLOSURE, PACKAGE AND METHOD OF MANUFACTURING

The present invention is directed to squeeze-and-turn child-resistant closures, to packages embodying such closures and to methods of manufacturing such closures.

BACKGROUND AND OBJECTS OF THE INVENTION

In squeeze-and-turn child-resistant closures, there are a pair of tabs on the closure that are disposed for engagement with a pair of lugs molded into a container, either on the container finish or on the shoulder of the container immediately beneath the container finish. The closure tabs are normally disposed at a position for circumferential engagement with the lugs on the container. If the closure is squeezed from opposed sides, the closure skirt is distorted sufficiently to permit the tabs to clear the lugs, and the closure to be unthreaded from the container finish. When the closure is threaded onto the container, the tabs on the closure ride over the lugs on the container, usually facilitated by angulated cam surfaces on the container lugs. The need to squeeze and distort the closure sidewall provides a child-resistant feature, whereby it is difficult for a child to remove the closure from the container and thereby obtain access to the contents of the container.

Squeeze-and-turn child-resistant closures of the described type are conventionally provided in single-wall designs and dual-wall designs. U.S. Pat. Nos. 3,917,097 and 3,941,268 illustrate single-wall designs, in which a single wall or skirt extends from the periphery of the closure base wall, with the closure internal threads being formed at the upper portion of the skirt and the lug-abutment tabs being formed at the lower periphery of the skirt. U.S. Pat. Nos. 4,117,945, 4,410,097, 5,687,863 and 5,915,576 illustrate dual-wall squeeze-and-turn closures, in which the closure internal thread is formed on the inner wall or skirt of the closure, and the tabs for abutting the container lugs are formed on the outer wall or skirt. In dual-wall closures of this character, the inner wall is spaced radially inwardly from the outer wall, and only the outer wall is distorted to remove the closure from a container. A problem with dual-wall squeeze-and-turn closures of this type is that they cannot readily be made of small size for use on small container finish sizes.

It is a general object of the present invention to provide a squeeze-and-turn child-resistant closure having a modified dual-wall construction that accommodates fabrication in all finish sizes, and that readily permits manufacture in small sizes suitable for use in conjunction with containers having reduced finish diameters. Another object of the present invention is to provide a closure of the described character in which the outer closure wall is configured to protect the force-application area for removing the closure, thereby resisting removal of the closure by application of planer force, such as by a child biting the external periphery of the closure. Yet another object of the invention is to provide a closure of the described character that requires reduced actuation force. A further object of the present invention is to provide a package that comprises a container and a squeeze-and-turn child-resistant closure of the described character, in which the lugs on the container not only resist removal of the closure in the absence of application of squeezing force to the proper areas of the closure, but also resist distortion of the outer wall of the closure. Yet another object of the invention is to provide a method of making or fabricating a squeeze-and-turn child-resistant closure of the described character.

SUMMARY OF THE INVENTION

A child-resistant closure in accordance with a presently preferred embodiment of the invention includes a base wall, a peripheral outer wall extending from the base wall, and an inner wall spaced radially inwardly from the outer wall and having an internal thread for securement to a container finish. The outer wall of the closure has diametrically opposed circumferential gaps, and the inner wall extends axially in radial alignment with the gaps in the outer wall for circumferential abutment with lugs on a shoulder of the container. The inner wall is flexible inwardly for clearing the container lugs and permitting removal of the closure from the container finish. The outer wall thus protects the force application area of the inner wall by reason of the fact that such force application area is recessed inwardly with respect to the circumference of the outer wall. The closure resists application of planer force to the removal area of the inner wall, such as by a child biting the closure. Furthermore, the modified dual-wall construction of the present invention may be constructed in small sizes suitable for use in conjunction with containers having small finish diameters.

In the preferred embodiment of the invention, the inner wall has diametrically opposed circumferentially spaced tabs that extend axially in radial alignment with the gaps in the outer wall. The gaps in the outer wall extend axially from the base wall to the axial edge of the outer wall, and the circumferential edges of the outer wall radially overlap the circumferential edges of the tabs at the gaps for enhanced protection of the tabs from inadvertent application of removal force. Radial webs connect the inner wall to the outer wall at the gaps in the region of the internal thread on the inner wall, thereby rigidifying the closure structure while leaving the tabs free to flex in the radial direction during application and removal of the closure from a container. The combination of the gaps in the outer wall and the tabs that extend axially from the inner wall form depressions that naturally guide the fingers of a user to the inner wall tabs that must be depressed in order to remove the closure from a container.

In accordance with another aspect of the present invention, there is provided a child-resistant package that comprises a closure of the described character in combination with a container having a finish with an external thread and at least one axial lug on the shoulder spaced from the thread. In the preferred embodiment of the invention, the container has diametrically opposed lugs on the shoulder of the container with clockwise-oriented radial faces disposed for abutment with the flexible lugs on the closure in an undeflected position of the tabs, thereby resisting removal of the closure. The container lugs have counterclockwise-oriented faces for camming the tabs radially inwardly as the closure is threaded onto the container finish. The radially outwardly oriented faces of the lugs are disposed radially inwardly of the outer wall for supporting the outer wall against radially inward movement or deflection.

In accordance with a third aspect of the present invention, a method of making a child-resistant closure includes a step of molding a closure of plastic construction having a base wall, a peripheral outer wall, and an inner wall spaced from the outer wall and having an internal thread. Diametrically opposed circumferential gaps are formed in the outer wall, and diametrically opposed flexible tabs are formed to extend axially from the inner wall in radial alignment with the gaps in the outer wall.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
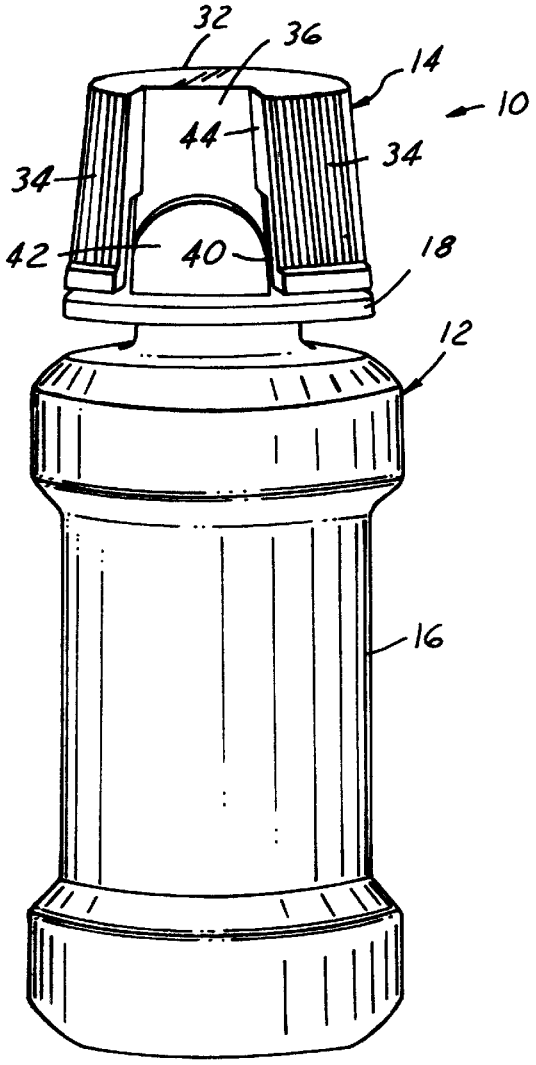
FIG. 1 is an elevational view of a closure and container package in accordance with one presently preferred embodiment of the invention.

The drawings illustrate a package 10 in accordance with one presently preferred embodiment of the invention as comprising a container 12 and a squeeze-and-turn child-resistant closure 14. Container 12, which is preferably of molded plastic construction, includes a body 16 having a shoulder 18 from which a finish 20 axially extends. A helical external thread 22 is formed on the outer surface of finish 20 for securement of a closure. A pair of lugs 24 extend axially from shoulder 18 on diametrically opposed sides of finish 20. Each lug 24 has a flat clockwise-oriented radially extending face 26, a convex counterclockwise-oriented and radially inwardly oriented face 28, and an arcuate radially outwardly oriented face 30. Container 12 may be of any suitable molded plastic composition.

Figure 4:
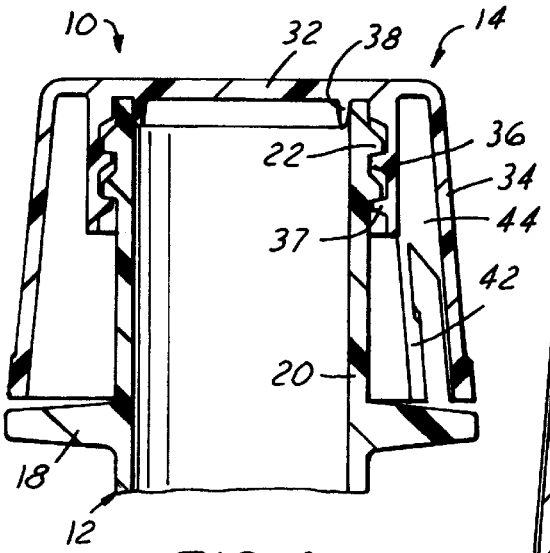
FIGS. 4 and 5 are sectional views of the closure and container finish in accordance with the present invention taken at differing angular orientations.
Figure 5:
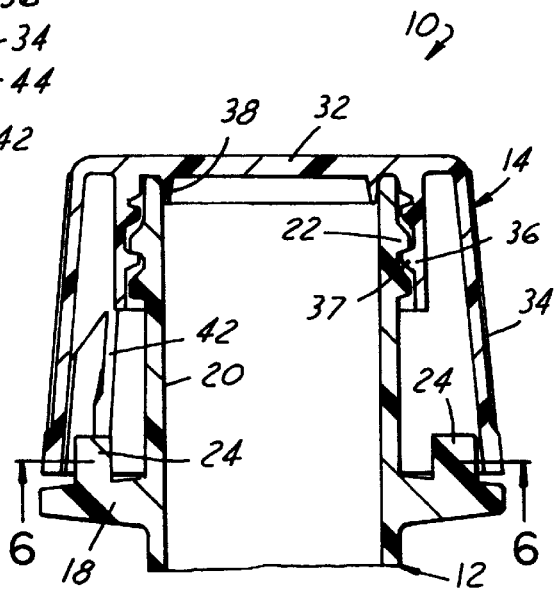
Figure 7:
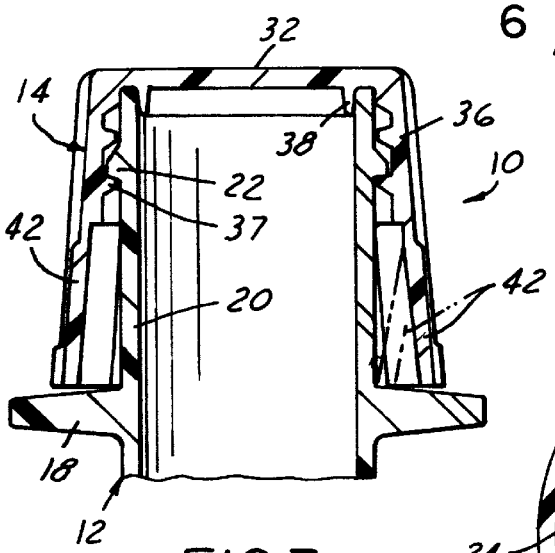
FIG. 7 is a sectional view taken substantially along the line 7—7 in FIG. 6.

Closure 14 is preferably of one-piece molded plastic composition such as polypropylene. Closure 14 has a flat base wall 32, a circumferentially discontinuous outer wall 34 extending from the periphery of base wall 32, and a circumferentially continuous inner wall 36 spaced radially inwardly from outer wall 34. Inner wall 36 has an internal thread 37 for engagement with external thread 22 on container finish 20 to secure the closure on the container. An annular lip 38 extends axially from base wall 32 and is spaced radially inwardly from inner wall 36 for plug-type sealing engagement with the inside diameter of container finish 20, as best seen in FIGS. 4, 5 and 7. Other seal designs such as a top or side seal can be employed with or without a liner within the scope of the present invention.

Figure 2:
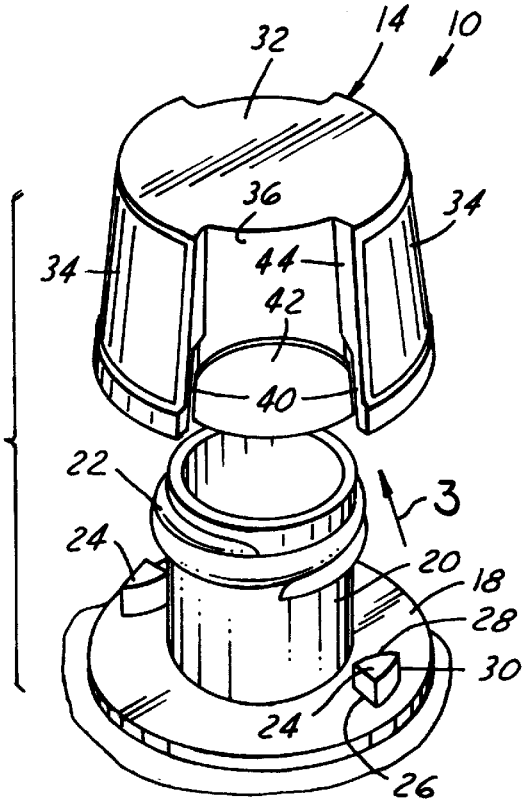
FIG. 2 is a fragmentary exploded perspective view of the package illustrated in FIG. 1.
Figure 3:
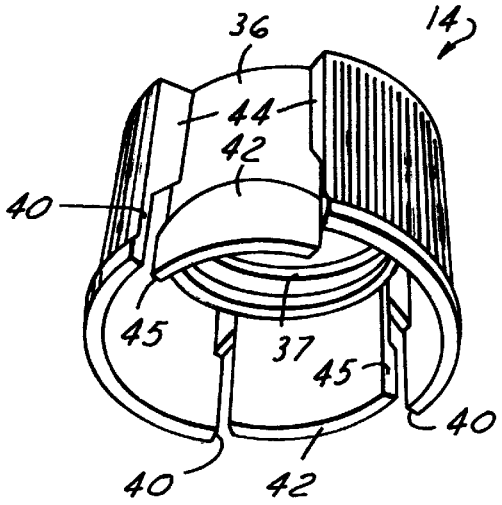
FIG. 3 is a bottom perspective view of the closure in FIGS. 1 and 2, being taken substantially from the direction 3 in FIG. 2.
Figure 6:
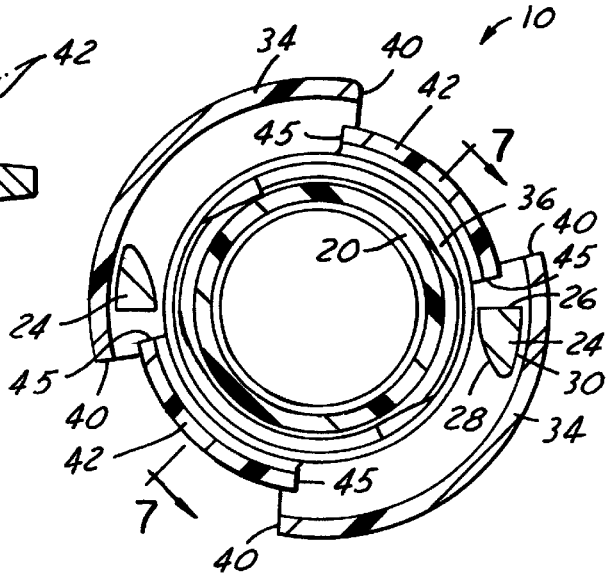
FIG. 6 is a sectional view taken substantially along the line 6—6 in FIG. 5.

Outer wall 34 has a pair of diametrically opposed gaps defined by circumferentially opposed straight parallel outer wall edges 40. As best seen in FIGS. 1–3, the gaps in outer wall 34 extend for the entire length of outer wall 34 from base wall 32 to the axial free edge of outer wall 34. A pair of diametrically opposed tabs 42 extend from inner wall 36 as an integral axial extension of the inner wall in radial alignment with and spaced radially inwardly form the diametrically opposed gaps in outer wall 34. Tabs 42 have arcuate thickened regions at the free ends of the tabs for engagement by the fingers of a user. The axial dimension of tabs 42 is such that the axial free edges of the tabs are substantially co-planer with the axial free edge of outer wall 34, as best seen in FIGS. 4–5. Tabs 42 are spaced from the axis of closure 14 for circumferential engagement with lugs 24 on container shoulder 18, as will be described. Radial webs 44 integrally interconnect inner wall 36 with outer wall 34 adjacent to closure base wall 32, while tabs 34 spaced from base wall 32 are disconnected from outer wall 34 and free to flex radially inwardly during application and removal of closure 14 to and from container 12. As best seen in FIG. 6, the circumferential edges 40 of outer wall 34 that define the gaps in the outer wall radially overlap the corresponding straight parallel circumferentially opposed edges 45 of tabs 42, which helps protect tabs 42 from inadvertent deflection. In the illustrated preferred embodiment of the invention, the gaps defined between edges 40 of outer wall 34 having a chordal dimension sufficient to accommodate finger access to tabs 42. This dimension is typically in the range of about one-half to about three-quarters of an inch, and this dimension would generally remain substantially constant for closures with larger or smaller diameters.

To apply closure 14 to container 12, inner wall 36 is positioned over container finish 20 and rotated in a clockwise direction to engage external finish thread 22 with internal thread 37 on closure wall 36. As the closure advances onto the container finish, rotation of the closure brings flexible tabs 42 into clockwise abutment with surfaces 28 on lugs 24. Surfaces 28 are angulated to cam the opposing edges of tabs 42 radially inwardly, so that the tabs ride along the inner edges of lugs 24, and then snap back radially outwardly after clearing the lugs (FIG. 6). If it is then attempted to remove closure 14 by simply grasping outer wall 34 and rotating counterclockwise, tabs 42 will be brought into circumferential abutment with flat faces 26 of lugs 24. This abutment resists removal of closure 14 from container 12. The flexible free edges of tabs 42 must be flexed and deflected radially inwardly so as to clear abutment faces 26 of lugs 24, which then permits counterclockwise unthreading of closure 14 with respect to container 12.

It will be noted that recession of tabs 42 with respect to outer wall 34 provides a number of significant advantages. For example, tabs 42 are effectively protected by being recessed with respect to outer wall 34, which resists application of a planer force to remove the closure, such as by a child biting outer wall 34. The fact that tabs 42 are freely deflectable with respect to inner wall 36 reduces actuation force. Furthermore, the modified dual-wall design of the present invention is usable in conjunction with all finish sizes, and particularly readily accommodates manufacture in small sizes for fitment to containers having small finish diameters. The gaps in the outer wall inherently tend to guide the fingers of a user to tabs 42, which must be depressed and deflected to facilitate removal. Lugs 24 are disposed radially inwardly of outer wall 34, and protect the outer wall from distortion during application of incorrect removal force. There has thus been disclosed a closure, a container/closure package and a method of closure manufacture that fully satisfy all of the objects and aims previously set forth. The closure, package and method have been disclosed in conjunction with presently preferred embodiments thereof. Alternatives and modifications will readily suggest themselves to persons of ordinary skill in the art. The present invention is intended to embrace all such alternatives and modifications as fall within the spirit and broad scope of the appended claims.

What is claimed is:

1. A child-resistant closure for a container having a finish with an external thread and an axial lug on a shoulder spaced from the thread, said closure being of integrally molded plastic construction and comprising:

a base wall, a peripheral outer wall, and an inner wall spaced from said outer wall and having an internal thread for securement to the container finish, said outer wall having diametrically opposed circumferential gaps, said inner wall extending axially in radial alignment with said gaps for circumferential abutment with the container lug, said inner wall being flexible inwardly for clearing the lug and permitting removal of the closure from the container finish.

2. The closure set forth in claim 1 wherein said inner wall has diametrically opposed circumferentially spaced tabs that extend axially in radial alignment with said gaps in said outer wall.

3. The closure set forth in claim 2 wherein said gaps in said outer wall extend axially from said base wall to a free axial edge of said outer wall.

4. The closure set forth in claim 3 further comprising radial webs that connect said inner wall to said outer wall at said gaps in said outer wall.

5. The closure set forth in claim 3 wherein said closure further includes an annular lip extending axially from said base wall and spaced radially inwardly from said inner wall for sealing engagement with an inside diameter of a container finish.

6. The closure set forth in claim 3 wherein said outer wall has straight parallel circumferentially opposed edges that radially overlap circumferentially opposed straight parallel edges of said tabs at said gaps.

7. The closure set forth in claim 6 wherein said gaps each have a chordal dimension of about one-half to about three-quarters of an inch.

8. A child-resistant package that comprises:

a container having a finish with an external thread and at least one axial lug on a shoulder spaced from said thread, and a closure of integrally molded plastic construction and comprising:

a base wall, a peripheral outer wall, and an inner wall spaced from said outer wall and having an internal thread for securement to the container finish, said outer wall having diametrically opposed circumferential gaps, said inner wall extending axially in radial alignment with said gaps for circumferential abutment with the container lug, said inner wall being flexible inwardly for clearing the lug and permitting removal of the closure from the container finish.

9. The package set forth in claim 8 wherein said inner wall has diametrically opposed circumferentially spaced tabs that extend axially in radial alignment with said gaps in said outer wall.

10. The package set forth in claim 9 wherein said container has diametrically opposed lugs on said shoulder with clockwise oriented radially faces disposed for abutment with said tabs in an undetected position of said tabs.

11. The package set forth in claim 10 further comprising radial webs that connect said inner wall to said outer wall at said gaps in said outer wall.

12. The package set forth in claim 10 wherein said closure further includes an annular lip extending axially from said base wall and spaced radially inwardly from said inner wall for sealing engagement with an inside diameter of a container finish.

13. The package set forth in claim 10 wherein said lugs have counterclockwise oriented faces for camming said tabs radially inwardly as said closure is threaded onto said finish.

14. The package set forth in claim 13 wherein said lugs have radially outwardly oriented arcuate faces disposed radially inwardly of said outer wall for supporting said outer wall against radially inward movement.

15. The package set forth in claim 10 wherein said gaps in said outer wall extend axially from said base wall to a free axial edge of said outer wall.

16. The package set forth in claim 15 wherein said outer wall has straight parallel circumferentially opposed edges that radially overlap circumferentially opposed straight parallel edges of said tabs at said gaps.

17. The package set forth in claim 16 wherein said gaps each have a chordal dimension of about one-half to about three-quarters of an inch.

18. A method of making a child-resistant closure that comprises the steps of:

(a) molding a closure of plastic construction comprising a base wall, a peripheral outer wall, and an inner wall spaced from said outer wall and having an internal thread, (b) forming diametrically opposed circumferential gaps in said outer wall, and (c) forming diametrically opposed flexible tabs that axially extend from said inner wall in radial alignment with said gaps.

* * * * *